US005725348A

United States Patent [19]

Drake

[11] Patent Number: 5,725,348

[45] Date of Patent: Mar. 10, 1998

[54] DUMPSTER AND VEHICLE MOUNTED LIFTING ARM THEREFOR

[76] Inventor: William K. Drake, General Delivery, Kenton, Manitoba, Canada, ROM OZO

[21] Appl. No.: 630,962

[22] Filed: Mar. 11, 1996

[51] Int. Cl.[6] ..... B66F 09/18

[52] U.S. Cl. ..... 414/408; 414/558; 414/486; 414/546; 414/406; 414/550; 220/1.5; 220/909

[58] Field of Search ..... 414/406, 407, 414/408, 409, 410, 419, 421, 486, 744.3, 487, 546, 735, 550, 558, 422, 729, 718; 220/1.5, 909, 908

[56] References Cited

U.S. PATENT DOCUMENTS

| | | | |
|---|---|---|---|
| 3,250,409 | 5/1966 | Beard et al. | 414/558 X |
| 3,263,835 | 8/1966 | Lugash | 414/558 |
| 3,937,337 | 2/1976 | Irving | 414/558 X |
| 4,711,613 | 12/1987 | Fretwell | 414/558 X |
| 5,026,104 | 6/1991 | Pickrell | 414/406 X |

FOREIGN PATENT DOCUMENTS

| | | | |
|---|---|---|---|
| 971732 | 11/1982 | U.S.S.R. | 414/408 |
| 1134483 | 1/1985 | U.S.S.R. | 414/408 |
| 1161433 | 6/1985 | U.S.S.R. | 414/408 |
| 1206203 | 1/1986 | U.S.S.R. | 414/408 |
| 1323471 | 7/1987 | U.S.S.R. | 414/408 |

*Primary Examiner*—Frank E. Werner

*Attorney, Agent, or Firm*—Adrian D. Battison; Murray E. Thrift

[57] ABSTRACT

The present invention provides a dumpster and a lifting arm for lifting the dumpster and dumping the contents of the dumpster into a storage box. The dumpster includes an open top and is for storing garbage or some other material and is supported on the ground. The articulated lifting arm is usually mounted beneath a vehicle or other transportation apparatus having an open topped storage box. The articulated lifting arm is arranged for lifting the dumpster from the supporting surface to a position above the storage box for dumping any material stored in the dumpster into the storage box. The articulated lifting arm comprises hydraulic devices, a base member, and arm member, first positioning means, an attachment member, lifting devices, and dumping\positioning devices.

19 Claims, 4 Drawing Sheets

DUMPSTER AND VEHICLE MOUNTED LIFTING ARM THEREFOR

FIELD OF THE INVENTION

The present invention provides a dumpster and lifting arm of the type for lifting the dumpster and dumping the contents of the dumpster into a storage box.

BACKGROUND

Presently much of the commercial garbage and other bulk waste being collected is first stored in large dumpsters and then collected by large waste disposal services. Emptying these dumpsters generally requires the use of a specialized garbage truck having a lifting mechanism with forks on either side of the truck cab and extending forwards of the cab. The forks engage slots on each side of a dumpster, and lift the dumpster up and over the cab, thereby dumping the contents of the dumpster into a storage box on the back of the truck. The need for a specialized vehicle for emptying the dumpster in this way makes this manner of waste collection expensive and therefore is usually only available to large waste disposal companies, and those who pay for their services.

As well the dumpsters used to collect garbage are often located along narrow back lanes behind places of business. Since the forks of the lifting mechanism used by existing vehicles extend out from the front of the vehicle it can often be difficult to maneuver the truck into position to lift the dumpster. This presents a second serious draw back for this manner of collecting waste material using vehicles with the forward facing lifting mechanism.

A dumpster and lifting arm is needed which allows for lifting of a dumpster from a side of a vehicle, and which provides a lifting arm that is inexpensive and is mountable on trucks, trailers, and other appropriate means for transporting the contents of a dumpster.

SUMMARY

According to the present invention there is provided a material storage and transportation apparatus comprising:

a transportation vehicle;

a storage box attached to the transportation vehicle having a bottom wall, side walls extending upwards from the bottom wall to a top, and an opening at a top;

a dumpster for storing material therein positioned on a supporting surface and having an opening at a top;

and an articulated lifting arm for lifting the dumpster from the supporting surface to a position above the storage box for dumping the stored material into the storage box through the opening at the top thereof, said articulated lifting arm having:

a base member including fixing means mounting the base member beneath the storage box;

an arm member having a first end and a second end, and having connection means at the first end for connecting the arm member to the base member;

first positioning means for moving the arm member from a transportation position lying beneath the storage box to a substantially horizontal lifting position extending outwards from the side of the storage box;

an attachment member being arranged at the second end of the arm member for engaging the dumpster, and having removable and reengageable connection means for connecting to said dumpster;

and lifting means for lifting the second end of the arm member such that the dumpster is moved to the dumping position above the storage box for dumping the material into said storage box.

Preferably the material storage and transportation apparatus includes dumping\positioning means. The dumping\repositioning means allow for the repositioning of the attachment member such that the top of the dumpster is angled downwards and towards the opening in the top of the storage box. This causes any material within the dumpster to be dumped into the storage box.

The attachment member preferably includes an elongate member being pivotally connected to the second end of the arm member extending outwards therefrom to a free end. The removable and reengageable connection means include the elongate member of the attachment means and a receptacle in a side of the dumpster for receiving the elongate member. Preferably the receptacle is rectangular in shape, and the elongate member is preferably rectangular in cross section, however any shape which will prevent rotation of the dumpster relative to the elongate member may be used as an alternative.

According to a second aspect of the invention there is provided an articulated lifting arm for use with a storage means and a container having a contents, said lifting arm lifting the container from the supporting surface to a position above the storage means for dumping the contents of the container into the storage means through the opening at the top thereof, said articulated lifting arm comprising:

a base member including fixing means mounting the base member beneath the storage means;

an arm member having a first end and a second end, and having connection means at the first end for connecting the arm member to the base member;

first positioning means for moving the arm member from a transportation position lying beneath the storage means to a lifting position extending outwards from the side of the storage means;

an attachment member being arranged at the second end of the arm member for engaging the container, and having removable and reengageable connection means for connecting to said container;

and lifting means for lifting the second end of the arm member such that the container is moved to the dumping position above the storage means for dumping the material into said storage means.

Preferably the articulated lifting arm includes dumping\positioning means. The dumping\repositioning means allow for the repositioning of the attachment member such that the top of the container is angled downwards and towards the opening in the top of the storage means. This causes any material within the dumpster to be dumped into the storage means.

The attachment member preferably includes an elongate member being pivotally connected to the second end of the arm member extending outwards therefrom to a free end. The removable and reengageable connection means include the elongate member of the attachment means and a receptacle in a side of the container for receiving the elongate member. Preferably the receptacle is rectangular in shape, and the elongate member is preferably rectangular in cross section, however any shape which will prevent rotation of the container relative to the elongate member may be used as an alternative.

According to a third aspect of the invention there is provided a dumpster for use with a lifting device comprising:

a container having side walls extending upwards from a bottom wall to a top, said top having an opening therein;

a hole arranged in at least one of a first opposing pair of the side walls;

an elongate hollow member having an opening at each end thereof and being arranged to extend between the first opposing pair of side walls and aligns with the at least one hole forming a receptacle for receiving an elongate lifting member attached to said lifting device;

and wherein the bottom wall extends between the first opposing pair of the side walls and includes a first portion sloping downwards and outwards from opposing sides of the elongate hollow member to a lowest point and a second portion extending from the lowest point outwards and substantially horizontally to a second opposing pair of the side walls.

This invention although primarily concerned with the storage and removal of garbage may be employed as a means of collection of any type of material which can first be stored in a dumpster, such as crops, produce, soil, etc.

As well the lifting arm need not be restricted to use on a wheeled vehicle and may be mounted any appropriate means of transporting the contents of a dumpster.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
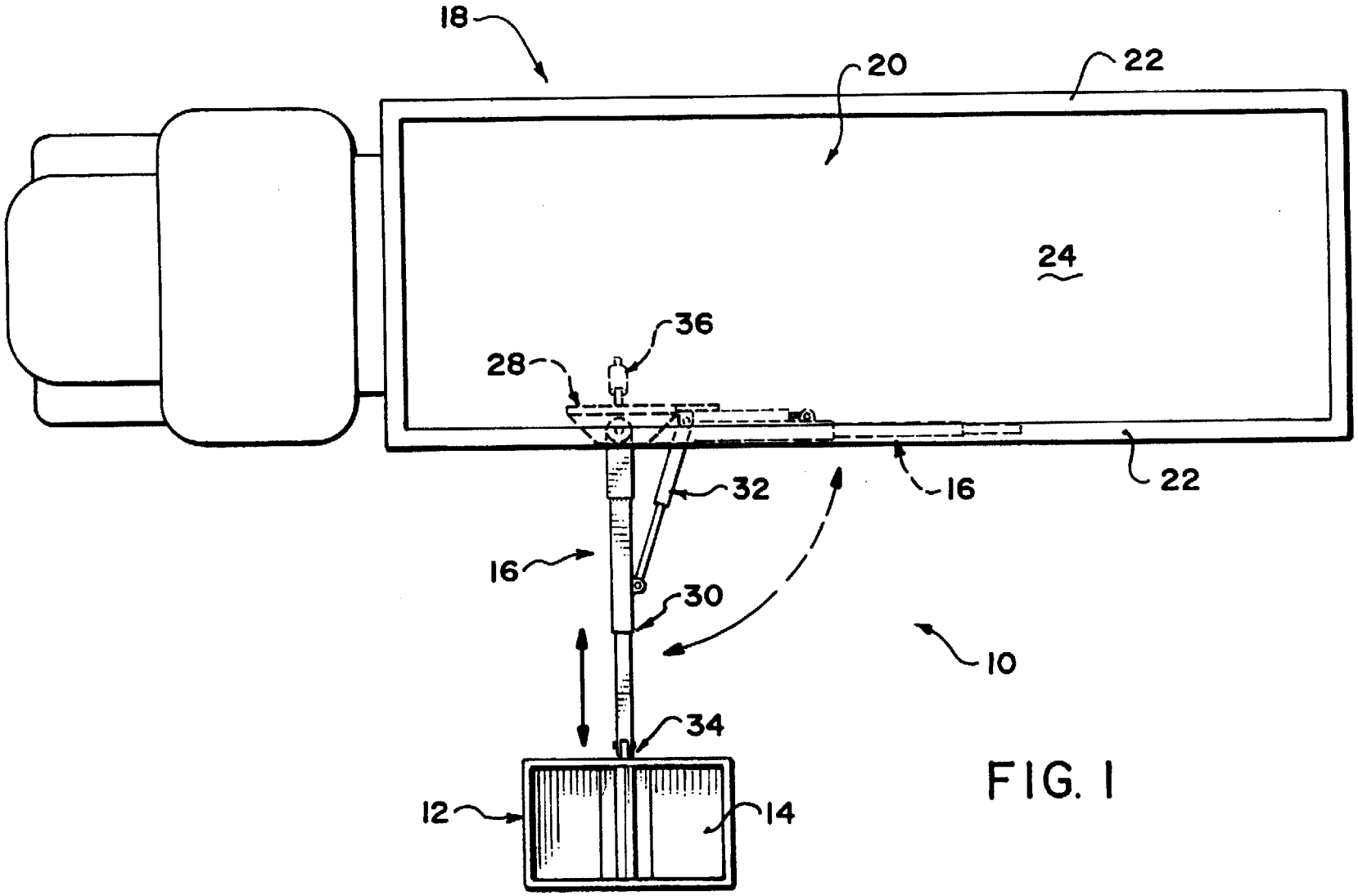
FIG. 1 is a top view of the transportation vehicle, dumpster and lifting arm.
Figures 2, 5:
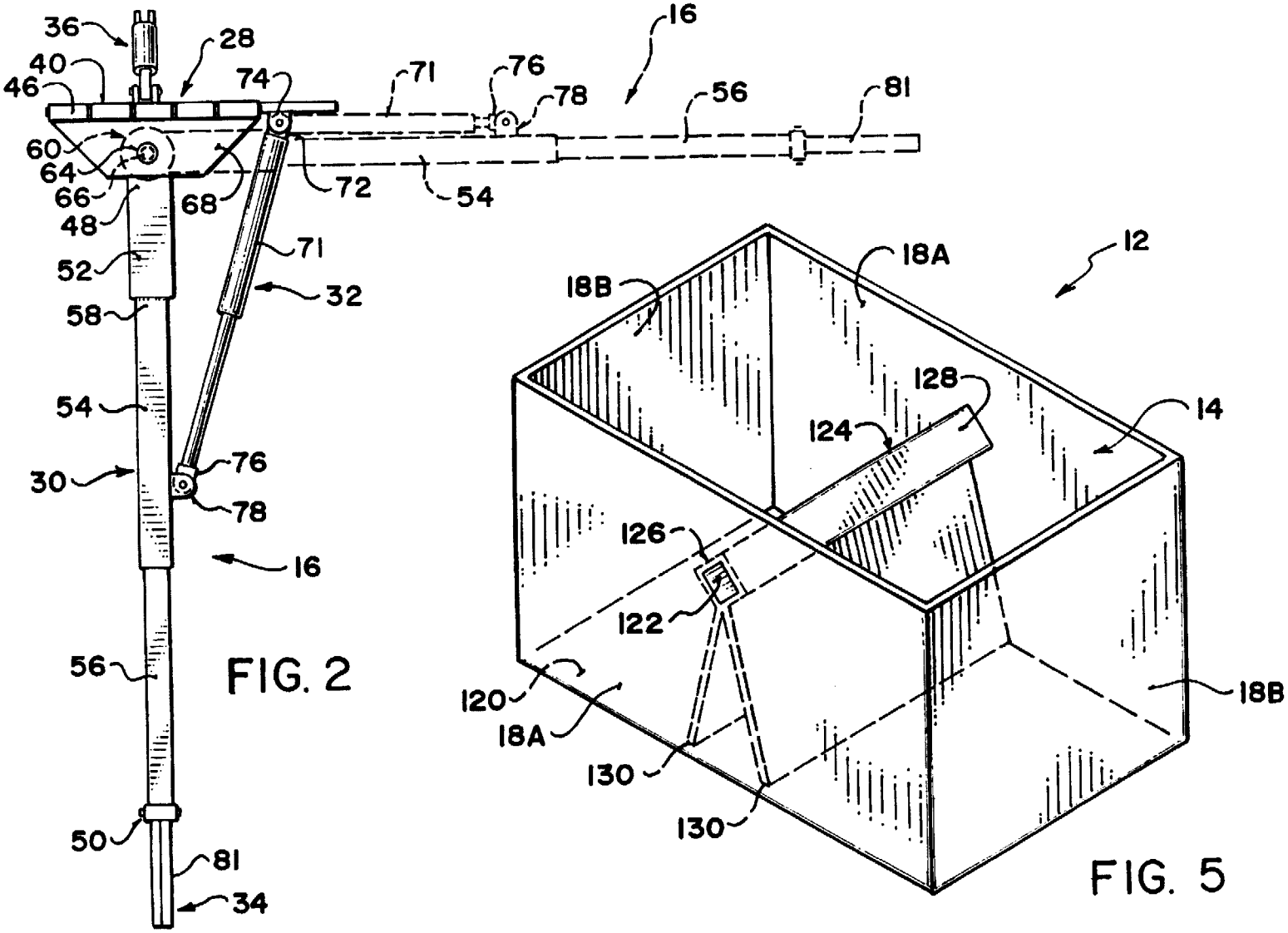
FIG. 2 is a top view of the arm.
FIG. 5 is an isometric view of the dumpster.

Referring FIGS. 1 and 2 the dumpster and articulated lifting arm are shown generally at 10. The dumpster 12 has an open top 14 which may or may not include a removable cover and is supported on the ground or other supporting surface. The dumpster 12 is used to store garbage or other materials. The articulated lifting arm 16 is shown mounted beneath the trailer 18 of a semi trailer truck having a storage box 20 with side walls 22 extending upwards from a bottom wall 24 to a top 26. The top 26 of the storage box 20 is open to allow material to be dumped into the box 20.

Figure 3:
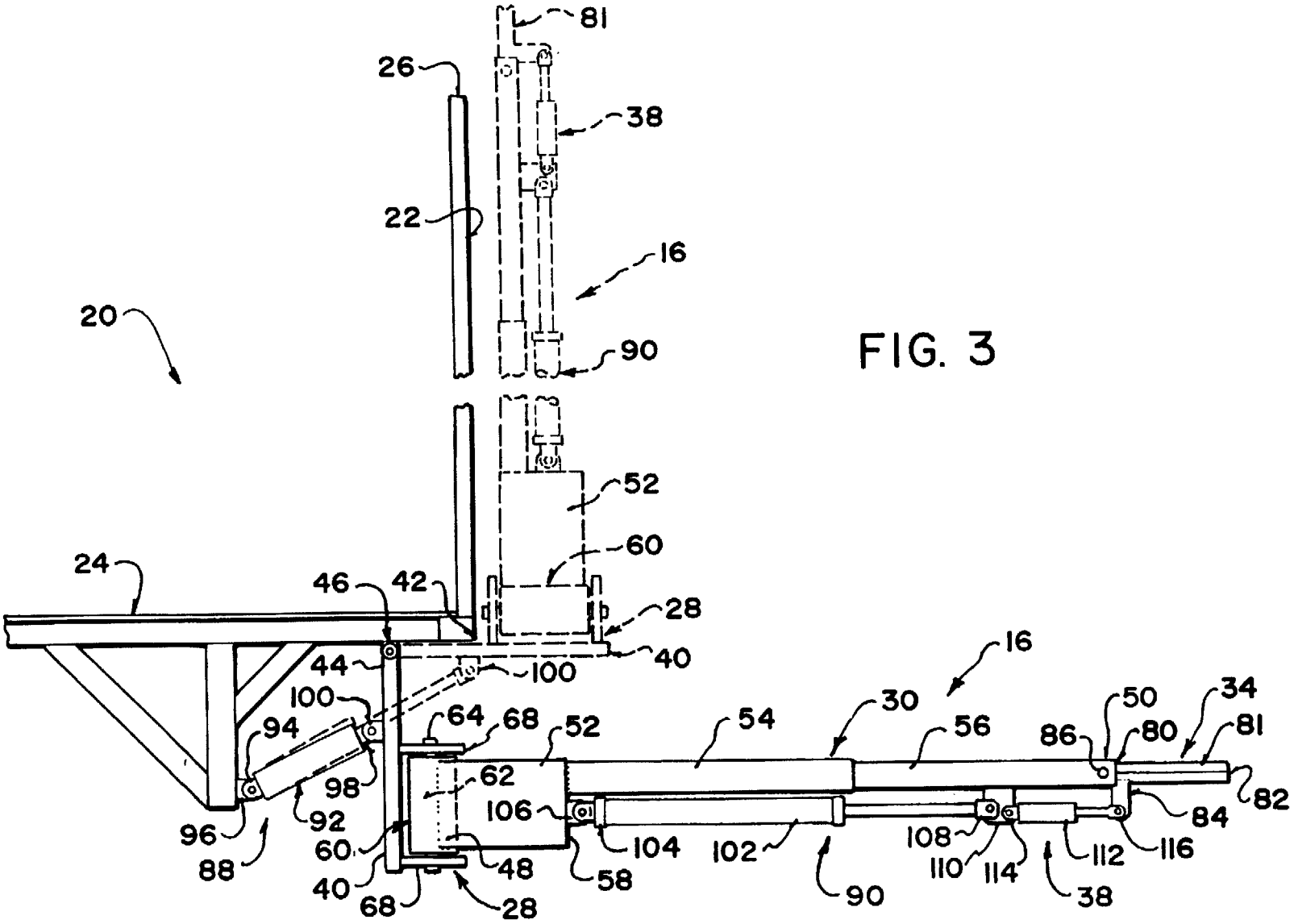
FIG. 3 is a side view of the arm.
Figure 4:
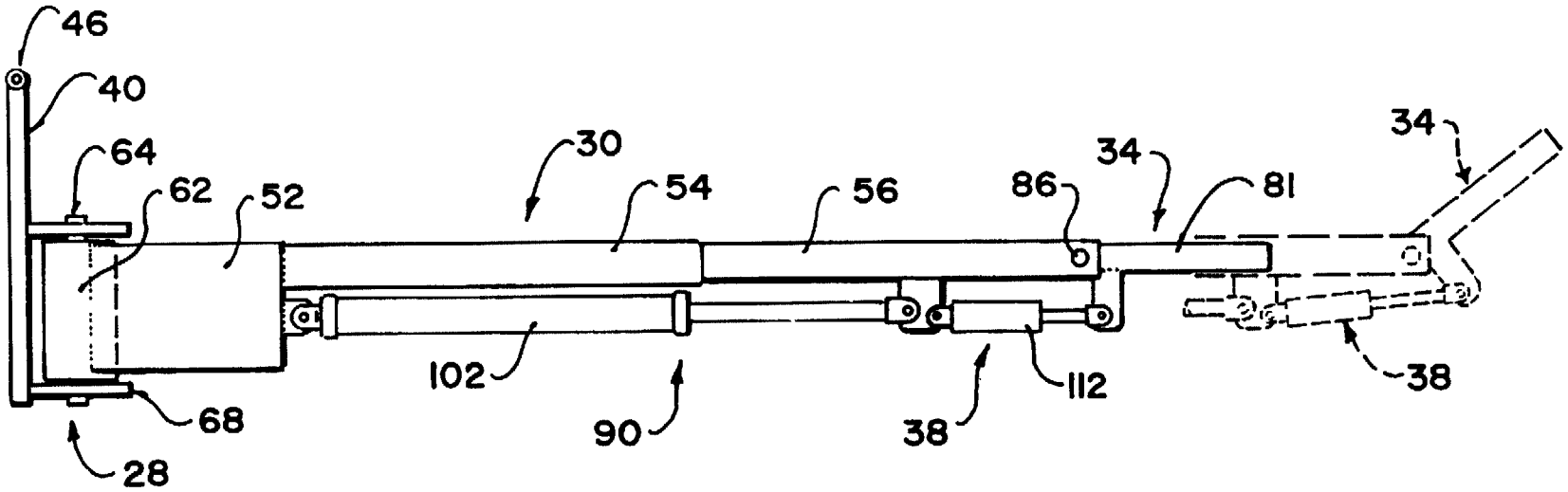
FIG. 4 is a side view of the arm showing the attachment means in a pivoted position.

Referring FIGS. 1, 2 and 3 the articulated lifting arm 16 is arranged for lifting the dumpster 12 from the supporting surface to a position above the storage box 20 for dumping any material stored in the dumpster 12 into the storage box 20 through the opening at the top 26 of the storage box 20. The articulated lifting 16 arm comprises a base member 28, an arm member 30, first positioning means 32 for repositioning the arm member in a horizontal plane, an attachment member 34 for attaching to the dumpster, a lifting means including a second positioning means 88 and an arm extension means 90 for repositioning the arm member 30 in a vertical plane and lifting the dumpster 12, and dumping\positioning means 38 for positioning the attachment member 34 for engaging the dumpster 12, and for dumping the dumpster.

The base member 28 comprises a plate 40 arranged in a horizontal plane beneath the storage box 20. The plate 40 lies parallel to one of the side edges 42 of the storage box 20 and is fixed at a top end 44 to the bottom wall 24 of the storage box 20 by a pivot connection 46. The pivot connection 46 has a horizontal axis of rotation, and is attached to the bottom wall 24 of the storage box 20 parallel and spaced inwards from the side edge 42, and to a top edge 44 of the plate 40 of the base member 28. The base member 28 extends downwards from the pivot connection 46 and is arranged to pivot about the horizontal axis of rotation. The plate 40 is sized such that when pivoted in a direction outwards from the side edge 42 into a horizontal position a majority of the plate 40 extends past the side wall 22 of the storage box 20.

The arm member 30 extends from a first end 48 adjacent the base member 28 to a free second end 50. The arm member 30 comprises a first arm section 52 arranged at the first end 48, and a pair of elongate telescoping members 54 and 56 fixed to an end 58 of the first arm section opposite the base member 28. The elongate telescoping members 54 and 56 comprise two elongate tubular members extending from the first arm section 52 to the second end 50 of the arm member 30. The telescoping members 54 and 56 are arranged to extend and retract longitudinally.

Referring to FIGS. 2 and 3 the arm member 30 is connected to the base member 28 by a pivot connection 60 at the first end 48 of the arm member 30. The pivot connection 60 is fixed to a first arm section 52 opposite the telescoping members. The pivot connection 60 comprises a vertical cylinder 62, and a pin member 64, the vertical cylinder 62 is fixed to the first end 48 of the arm member 30 with a vertical hole 66 extending longitudinally therethrough. The pin member 64 is fixed between two flanges 68 fixed to an outwardly facing face 70 of the base member 28, such that the pin member 64 extends through the vertical hole 66 in the vertical cylinder 62. The vertical cylinder 62 is arranged to rotate freely about a vertical axis through the pin member 64.

Referring to FIG. 2 when the base member 28 is in a vertical position the arm member 30 may be pivoted in a substantially horizontal plane by a first positioning means 32 from a transportation position lying beneath the storage box to the lifting position extending outwards from the side of the storage box.

The first positioning means 32 comprise a hydraulic cylinder 71 which is fixed at a first end 72 by a pin connection to a flange 74 on the base member 28 and is fixed at a second end 76 by a pin connection to a flange 78 on a side of the first arm section 52. The hydraulic cylinder 71 is arranged such that actuating the hydraulic cylinder 71 in a first direction extends the hydraulic cylinder 71 moving the first arm 52 section away from the base member 28 thereby pivoting the arm member 30 from the transportation position lying beneath the storage box 28 to the lifting position. Actuating the hydraulic cylinder 71 in a second direction retracts the hydraulic cylinder 71 moving the first arm section 52 towards the base member 28 thereby pivoting the arm member 30 from the lifting position to the transportation position lying beneath the storage box 20.

The attachment member 34 is arranged at the second end 50 of the arm member 30 for engaging the dumpster 12, and has removable and reengageable connection means for connecting to the dumpster 12. The attachment member 34 is an elongate member 81 which is pivotally connected at a first end 80 to the second end 50 of the arm member 30. The elongate member 81 is rectangular in cross section and extends outwards from the second end 50 of the arm member 30 to a free second end 82. A flange 84 is fixed to the elongate member 81 adjacent its first end 80, and projects downwards from and perpendicular to the elongate member 81.

The pivot connection 86 connecting the elongate member 81 to the arm member 30 is arranged to rotate about a horizontal axis when the articulated lifting arm 16 is in the transportation position.

The removable and reengageable connection means comprise the elongate member 81 of the attachment means 34 and a receptacle in a side of the dumpster 12. The receptacle is sized and arranged to receive the elongate member 81 for lifting the dumpster 12.

The lifting means lift the arm member 30 such that when the dumpster 12 is connected to the arm member 30 it is moved to a dumping position above the storage box 20 for dumping the material into the storage box 20. The lifting means 36 include a second positioning means 88 for moving the arm member 30 from a horizontal position upwards and inwards to a vertical position next to the side wall 22 of the storage box 20, and an arm extension means 90 for extending and retracting the arm member 30 longitudinally. The extension means 90 is arranged such that when the arm member 30 is in the vertical position the attachment member 34 is moved upwards as the arm member is extended and downwards as the arm member 30 is retracted.

The second positioning means 88 comprise a hydraulic cylinder 92 fixed at a first end 94 by a pin connection to a flange 96 fixed to the storage box 20 and fixed at a second end 98 by a pin connection to a flange 100 on the base member 28. The hydraulic cylinder 92 is arranged such that actuating the hydraulic cylinder 92 in a first direction extends the hydraulic cylinder 92 causing the base member 28 to pivot outwards and upwards in to a horizontal position. This in turn causes the arm member 30 to be repositioned from the horizontal lifting position upwards and inwards to a vertical position adjacent the side wall 22 of the storage box 20. Actuating the hydraulic cylinder 92 in a second direction retracts the hydraulic cylinder 92 moving the base member 28 inwards and downwards to the vertical position causing the arm member 30 to return to the horizontal lifting position from the substantially vertical position.

The arm extension means 90 comprise an elongate hydraulic cylinder 102 lying parallel to the arm member 30. The elongate hydraulic cylinder 102 is fixed at a first end 104 by a pin connection to a flange 106 on the first arm 52 section of the arm member 30, and is fixed at a second end 108 by a pin connection to a flange 110 on the second one of the telescoping elongate members 56.

The dumping\positioning means 38 provide a means of repositioning the attachment member 34 making it possible to engage the receptacle on the side of the dumpster 12 during lifting, and for dumping the contents of the dumpster 12 after lifting. The dumping\positioning means 38 allow the dumpster to be repositioned when held aloft such that the top of the dumpster is angled downwards and towards the opening in the top of the storage box. This causes the material within the dumpster to be dumped into the storage box.

The dumping\positioning means comprise an hydraulic cylinder 112 fixed at a first end 114 by a pin connection to the flange 110 at the second end 50 of the first arm member 30, and fixed at a second end 116 by a pin connection to the flange 84 projecting perpendicular and downwards from the elongate member 81 of the attachment means 34. The dumping\positioning means 38 are arranged such that extending and retracting the hydraulic cylinder 112 causes the elongate member 81 to pivot about the pivot connection 86 relative to the second end 50 of the arm member 30 allowing the elongate member 81 to be positioned to engage the dumpster 12. When the dumpster 12 is held aloft by the arm member 30 pivoting the elongate member 81 causes the dumpster 12 to be tilted towards the storage box 20 for dumping.

The dumpster 12 comprises a rectangular container having side walls 118*a* and 118*b* extending upwards from a bottom wall 120 to a top 14. The dumpster 12 is open topped, but may include a hinged cover which allows the contents of the dumpster 12 to be easily dumped.

A rectangular hole 122 is arranged in one of a pair of opposing side walls 118*a*. The rectangular hole 112 is aligned with a rectangular elongate hollow member 124 which extends between the pair of opposing side wails 118*a*. The elongate hollow member 124 and the rectangular hole 112 form the receptacle which receives the elongate lifting member 81.

The bottom wall 120 extends between the opposing pair of side walls 118*a* and slopes downwards and outwards from opposing sides 126 and 128 of the elongate hollow member 124 to a lowest point 130 and then extends from the lowest point 130 outwards and horizontally to the second opposing pair of the side walls 118*b*.

This invention although primarily concerned with the storage and removal of garbage may be employed as a means of collection of any type of material which can first be stored in a dumpster, such as crops, produce, soil, etc.

As well the lifting arm need not be restricted to use on a wheeled vehicle and may be mounted any appropriate means of transporting the contents of a dumpster.

While one embodiment of the present invention has been described in the foregoing, it is to be understood that other embodiments are possible within the scope of the invention. The invention is to be considered limited solely by the scope of the appended claims.

I claim:

1. A material storage and transportation apparatus comprising:

a transportation vehicle;

a storage box attached to the transportation vehicle having a bottom wall, side walls extending upwards from the bottom wall to a top, and an opening at a top;

a dumpster for storing material therein positioned on a supporting surface and having an opening at a top;

and an articulated lifting arm for lifting the dumpster from the supporting surface to a position above the storage box for dumping the stored material into the storage box through the opening at the top thereof, said articulated lifting arm having:

a base member including fixing means mounting the base member beneath the storage box;

an arm member having a first end and a second end, and having connection means at the first end for connecting the arm member to the base member;

first positioning means for moving the arm member from a transportation position lying beneath the storage box to a substantially horizontal lifting position extending outwards from a side of the storage box;

an attachment member being arranged at the second end of the arm member for engaging the dumpster, and having removable and reengageable connection means for connecting to said dumpster;

and lifting means for lifting the second end of the arm member such that the dumpster is moved to the dumping position above the storage box for dumping the material into said storage box.

2. A material storage and transportation apparatus in accordance with claim 1 wherein the articulated lifting arm includes dumping\positioning means for repositioning the attachment member such that the top of the dumpster is angled downwards and towards the opening in the top of the storage box, thereby causing the material within the dumpster to be dumped into the storage box.

3. A material storage and transportation apparatus in accordance with claim 2 wherein the fixing means mounting the base member beneath the storage box is a pivot connection, said pivot connection being attached to the bottom wall of the storage box parallel and adjacent to a side edge thereof, and being attached along a top edge of the base member such that the base member extends downwards therefrom.

4. A material storage and transportation apparatus in accordance with claim 3 wherein the pivot connection mounting the base member beneath the storage box is spaced inwards from said side edge, and arranged to pivot about a horizontal axis.

5. A material storage and transportation apparatus in accordance with claim 1 wherein the arm member is longitudinally extendible.

6. A material storage and transportation apparatus in accordance with claim 5 wherein the arm member comprises a first arm section arranged at the first end of the arm member, and a plurality of elongate telescoping members extending from the first arm section to the second end of the arm member.

7. A material storage and transportation apparatus in accordance with claim 6 wherein the plurality of elongate telescoping members comprise two elongate tubular members.

8. A material storage and transportation apparatus in accordance with claim 6 wherein the connection means connecting the arm member to the base member comprises a pivot connection fixed to the first arm section at an end opposite the plurality of elongate telescoping members, said pivot connection being arranged to pivot about a vertical axis such that the arm member may be pivoted from the transportation position lying beneath the storage box to the lifting position extending outwards from the side of the storage box.

9. A material storage and transportation apparatus in accordance with claim 8 wherein the first positioning means comprise a hydraulic cylinder fixed at a first end by a pin connection to a flange on the base member and being fixed at a second end by a pin connection to a flange on the first arm section, said hydraulic cylinder being arranged such that actuating the hydraulic cylinder in a first direction extends the hydraulic cylinder moving the first arm section away from the base member thereby pivoting the arm member from the transportation position lying beneath the storage box to the lifting position, and such that actuating the hydraulic cylinder in a second direction retracts the hydraulic cylinder moving the first arm section towards the base member thereby pivoting the arm member from the lifting position to the transportation position lying beneath the storage box.

10. A material storage and transportation apparatus in accordance with claim 1 wherein the lifting means include a second positioning means for moving the arm member from a substantially horizontal position upwards and inwards to a substantially vertical position adjacent a side of the storage box, and arm extension means for extending and retracting the arm member longitudinally such that when in the substantially vertical position the attachment member is moved upwards as the arm member is extended.

11. A material storage and transportation apparatus in accordance with claim 10 wherein the second positioning means comprise a hydraulic cylinder fixed at a first end by a pin connection to a flange on the storage box and being fixed at a second end by a pin connection at a second end to a flange on the base member, said hydraulic cylinder being arranged such that actuating the hydraulic cylinder in a first direction extends the hydraulic cylinder pivoting the base member outwards and upwards causing the arm member to move from the substantially horizontal lifting position upwards and inwards to a substantially vertical position adjacent a side of the storage box, and such that actuating the hydraulic cylinder in a second direction retracts the hydraulic cylinder moving the base member inwards and downwards causing the arm member to move from a substantially vertical position adjacent a side of the storage box to the substantially horizontal lifting position.

12. A material storage and transportation apparatus in accordance with claim 10 wherein the arm extension means comprise an elongate hydraulic cylinder fixed at a first end by a pin connection to a flange on the first arm section of the arm member, and being fixed at a second end by a pin connection to a flange at the second end of the arm member.

13. A material storage and transportation apparatus in accordance with claim 12 wherein the attachment member includes an elongate member being pivotally connected at a first end to the second end of the arm member extending outwards therefrom to a free end, and a flange fixed to said elongate member adjacent the first end thereof, and projecting perpendicular therefrom.

14. A material storage and transportation apparatus in accordance with claim 13 wherein the pivot connection connecting the attachment means to the arm member is arranged to rotate about a horizontal axis when the articulated lifting arm is in the transportation position.

15. A material storage and transportation apparatus in accordance with claim 13 wherein the removable and reengageable connection means comprise the elongate member of the attachment means and a receptacle in a side of the dumpster, said receptacle being sized and arranged to receive the elongate member for lifting the dumpster.

16. A material storage and transportation apparatus in accordance with claim 15 wherein a hole in the side of the dumpster is rectangular in shape, and the elongate member is rectangular in cross section.

17. A material storage and transportation apparatus in accordance with claim 13 wherein the dumping\positioning means comprise an elongate hydraulic cylinder fixed at a first end by a pin connection to a flange at the second end of the first arm member, and being fixed at a second end by a pin connection to the flange projecting perpendicular from the elongate member, dumping\positioning means being arranged such that extending and retracting the hydraulic cylinder causes the elongate member to be repositioned for engaging the dumpster and for dumping the dumpster.

18. An articulated lifting arm for use with a storage means and a container having a contents, said lifting arm lifting the container from a supporting surface to a position above the storage means for dumping the contents of the container into the storage means through an opening at a top thereof, said articulated lifting arm comprising:

a base member including fixing means mounting the base member beneath the storage means;

an arm member having a first end and a second end, and having connection means at the first end for connecting the arm member to the base member;

first positioning means for moving the arm member from a transportation position lying beneath the storage means to a lifting position extending outwards from a side of the storage means;

an attachment member being arranged at the second end of the arm member for engaging the container, and having removable and reengageable connection means for connecting to said container;

and lifting means for lifting the second end of the arm member such that the container is moved to the dumping position above the storage means for dumping the material into said storage means.

19. A material storage and transportation apparatus in accordance with claim 18 wherein the articulated lifting arm includes dumping means for repositioning the attachment member such that the top of the container is angled downwards and towards the opening in the top of the storage means, thereby causing the material within the dumpster to be dumped into the storage means.

* * * * *